US007021785B2

(12) United States Patent
Rubin

(10) Patent No.: US 7,021,785 B2
(45) Date of Patent: Apr. 4, 2006

(54) MINIATURE PORTABLE ORNAMENTAL TREE DEVICE

(75) Inventor: Jonathan Rubin, Portchester, NY (US)

(73) Assignee: Jonathan R. Rubin, Portchester, NY (US)

( * ) Notice: Subject to any disclaimer, the term of this patent is extended or adjusted under 35 U.S.C. 154(b) by 0 days.

(21) Appl. No.: 10/637,826

(22) Filed: Aug. 8, 2003

(65) Prior Publication Data

US 2004/0032732 A1 Feb. 19, 2004

Related U.S. Application Data

(63) Continuation of application No. 09/638,764, filed on Aug. 15, 2000, now abandoned.

(51) Int. Cl.
*F21S 6/00* (2006.01)

(52) U.S. Cl. ..... 362/123; 362/86; 362/397

(58) Field of Classification Search ..... 362/86, 362/122, 123, 397, 568, 800; 40/442–444; 428/11; D26/101
See application file for complete search history.

(56) References Cited

U.S. PATENT DOCUMENTS

| | | | | |
|---|---|---|---|---|
| 4,511,607 A | | 4/1985 | White | 428/13 |
| 5,213,407 A | * | 5/1993 | Eisenbraun | 362/123 |
| 5,237,764 A | | 8/1993 | Gray | 40/473 |
| 5,315,492 A | * | 5/1994 | Davenport | 362/122 |
| 5,396,408 A | | 3/1995 | Szczech | 362/397 |
| 5,702,170 A | | 12/1997 | Broderick | 362/32 |
| 5,939,154 A | | 8/1999 | Gonzalez | 428/8 |
| 5,971,172 A | | 10/1999 | Cockerham | 211/181 |
| 6,053,798 A | | 4/2000 | Tang | 446/501 |

* cited by examiner

*Primary Examiner*—Stephen Husar

(57) ABSTRACT

The present invention is a miniature illuminating Christmas tree intended to create a decorative display in the window of a home, car, or office. In the preferred mode, the tree-shaped ornament is made from plastic and artificial green Christmas tree material and contains an illumination source, such as blinking LEDs, fiberoptics, or bulbs configured according to a previously determined pattern. A power source, such as at least one battery, is housed in the base or trunk of the ornament. The device is removably attached to a window through usage of one or more suction cups, and may be reversed, allowing the user to display the object on the outside or the inside of the window in question.

4 Claims, 2 Drawing Sheets

MINIATURE PORTABLE ORNAMENTAL TREE DEVICE

This Application is a continuation of application Ser. No. 09/638,764, filed Aug. 15, 2000 now abandoned by present Applicant.

BACKGROUND OF THE INVENTION

1. Field of the Invention

The present invention is a miniature illuminating Christmas tree intended to create a decorative display in the window of a home, car, or office. In the preferred mode, the tree-shaped ornament is made from plastic and artificial green Christmas tree material and contains an illumination source, such as blinking LEDs, fiberoptics, or bulbs, which may be configured in a variety of previously determined patterns. A power source, such as at least one battery, is housed in the base or trunk of the ornament. The device is removably attached to a window through usage of one or more suction cups, and may be reversed, allowing the user to display the object on the outside or the inside of the window in question.

2. Description of the Prior Art

Numerous innovations for miniature or portable ornamental devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 5,939,154, invented by Gonzalez entitled "Space Saving Christmas Tree Kit"

The patent to Gonzales describes a space-saving Christmas tree kit for mounting to a surface, such as a window. The device includes an elongated trunk member and a plurality of elongated branch members shaped and formed to resemble branches of a pine tree. The trunk has a plurality of spaced-apart suction cups outwardly extending from the back of the trunk for mounting the member to a surface. The kit also includes a star, a plurality of ornaments, and a string of lights which are adapted to be mounted to a tree. The branch members are couplable to the trunk so that the trunk and branch members resemble a pine tree.

2. U.S. Pat. No. 4,511,607, invented by White, entitled Window-Mounted Christmas Tree"

The patent to White describes a window-mounted artificial Christmas tree is provided to be located adjacent the inside of a picture window. The artificial Christmas tree extends substantially the full height of the window and has an upright supporting member engagable with a generally horizontal surface of a lower frame member below the window. A resiliently mounted extension member is located at the top of the upright supporting member and engages a generally horizontal surface of an upper frame member above the window. The upright supporting member supports a plurality of artificial tree branches with the lower branches being longer than the upper ones and preferably with the branches at any given height which extend generally parallel to the window being longer than those extending transversely to the window to provide a generally semi-elliptical shape in horizontal cross section. The artificial Christmas tree thereby takes up a minimum amount of space within the room. Further, it is fully exposed through the window to provide the advantages of an outside decorated tree without the disadvantages thereof.

3. U.S. Pat. No. 6,053,798, invented by Tang, entitled "Structural Improvement of Toy Christmas Tree"

The patent to Tang describes a structural improvement of toy Christmas tree, involving mainly a foundation unit that is installed on top of a base to accommodate the entire mechanism of the invention, on the side of the lower part of the foundation unit is installed a motor which intermittent off-and-on rotation is controlled by a control circuit board installed in the base, the motor being linked with a reduction gear and a spring to drive a toy lower jaw part at the lower part of the foundation unit, and a driving rod to activate a toy eyebrow part that is located at the upper part of the foundation unit, thereby, once the power of the invention is switched on, the control circuit board will play happy music and flash LED light (the lamps being installed in the eyeball part), while the motor will drive the eyebrows and mouth of the Christmas tree to flip up and down and open and close, to create a fun image, meanwhile, its construction more simplified than conventional models will enable effective reduction of costs and enhancement of performance.

4. U.S. Pat. No. 5,702,170, invented by Broderick, entitled "Fibre Optics Christmas Tree"

The patent to Broderick describes a fiber optics Christmas tree comprising a hollowed out artificial Christmas tree frame. A structure is for transmitting light through the hollowed out artificial Christmas tree frame. A facility is for supplying light to the light transmitting structure within the hollowed out artificial Christmas tree frame, so that points of light can be seen at distal ends of the light transmitting structure in the hollowed out artificial Christmas tree frame.

5. U.S. Pat. No. 5,971,172, invented by Cockerham, entitled "Folding Artificial Christmas Tree Frame"

The patent to Chockerham describes a folding artificial Christmas frame adapted to be mounted onto a vertical structure, such as a wall, a door or the like. The frame includes a generally triangular top frame portion that is hingedly connected to a bottom frame portion having a generally truncated triangular shape. The top and bottom frame portions may be folded together to facilitate storage.

6. U.S. Pat. No. 5,396,408, invented by Szczech, entitled "Detachable Window Decoration"

The patent to Szczech describes a detachable window ornament that includes a plurality of light sources inside a plenum formed from an opaque rear wall, a continuous side wall extending about it, and a front, translucent panel. Attached to the side walls are a number of suction cups that allow the device to be removably attached to the window. The front panel can carry a variety of different ornamental displays, such as those relating to a specific holiday, or the like. Additionally, it is contemplated that the device could be attached to one of the windows of an automobile.

7. U.S. Pat. No. 5,237,764, invented by Gray, entitled "Solar Driven Novelty Device"

The Gray invention comprises a solar-driven device including a frame having a first and second side; an adjustable solar panel attached to the frame; a rotatable disk disposed on the frame; a motor in operative connection with the solar panel and disk, wherein the motor causes the disk to rotate in response to electricity generated by the solar panel and transmitted to the motor; and suction cups for attaching the frame to the surface, the suction cups being adjustable to permit either the first side of the frame or the second side of the frame to be adjacent to the surface.

In summation, it is suggested that the above-listed patents to Gonzalez and White represent the closest prior art in concept and theme. However, in contrast to the above devices, the present invention is a miniature artificial green Christmas tree removably attached to a window through usage of at least one suction cup. The suction cup may be reversed to allow for display on either the outside or inside of the window. Importantly, unlike the prior art, a battery may be housed within the trunk of the tree, conveniently allowing for an illumination source such as blinking LEDs, fiberoptics, or bulbs, not found in the above patents.

SUMMARY OF THE INVENTION

As noted above, the present invention is a miniature illuminating Christmas tree intended to create a decorative display in the window of a home, car, or office. In the preferred mode, the tree-shaped ornament is made from plastic and artificial green Christmas tree material and contains an illumination source, such as blinking LEDs, fiberoptics, or bulbs, configured in one of a variety of patterns and arrangements. A power source, such as at least one battery, is housed in the base or trunk of the ornament. The device is removably attached to a window through usage of one or more suction cups, and may be reversed, allowing the user to display the object on the outside or the inside of the window in question.

In light of the foregoing, it is an object of the present invention to provide an ornamental device that is suitable for using in conjunction with holiday decorations, such as other Christmas ornaments or lights.

It is a further object of the invention to provide an ornamental device that simulates an actual Christmas tree, although in a compact and portable configuration.

It is also an object of the present invention to provide a unique ornament that is lightweight and transportable, so as to be placed in any house, car, or office.

It is a further object to provide an ornamental device that is relatively simple to manufacture and substantially inexpensive.

In addition, it is an object of the present invention to provide an ornamental device that may be of substantially any size or configuration, to best fit the decor and space limitations of the area in which it is displayed.

The novel features which are considered characteristic for the invention are set forth in the appended claims. The invention itself, however, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
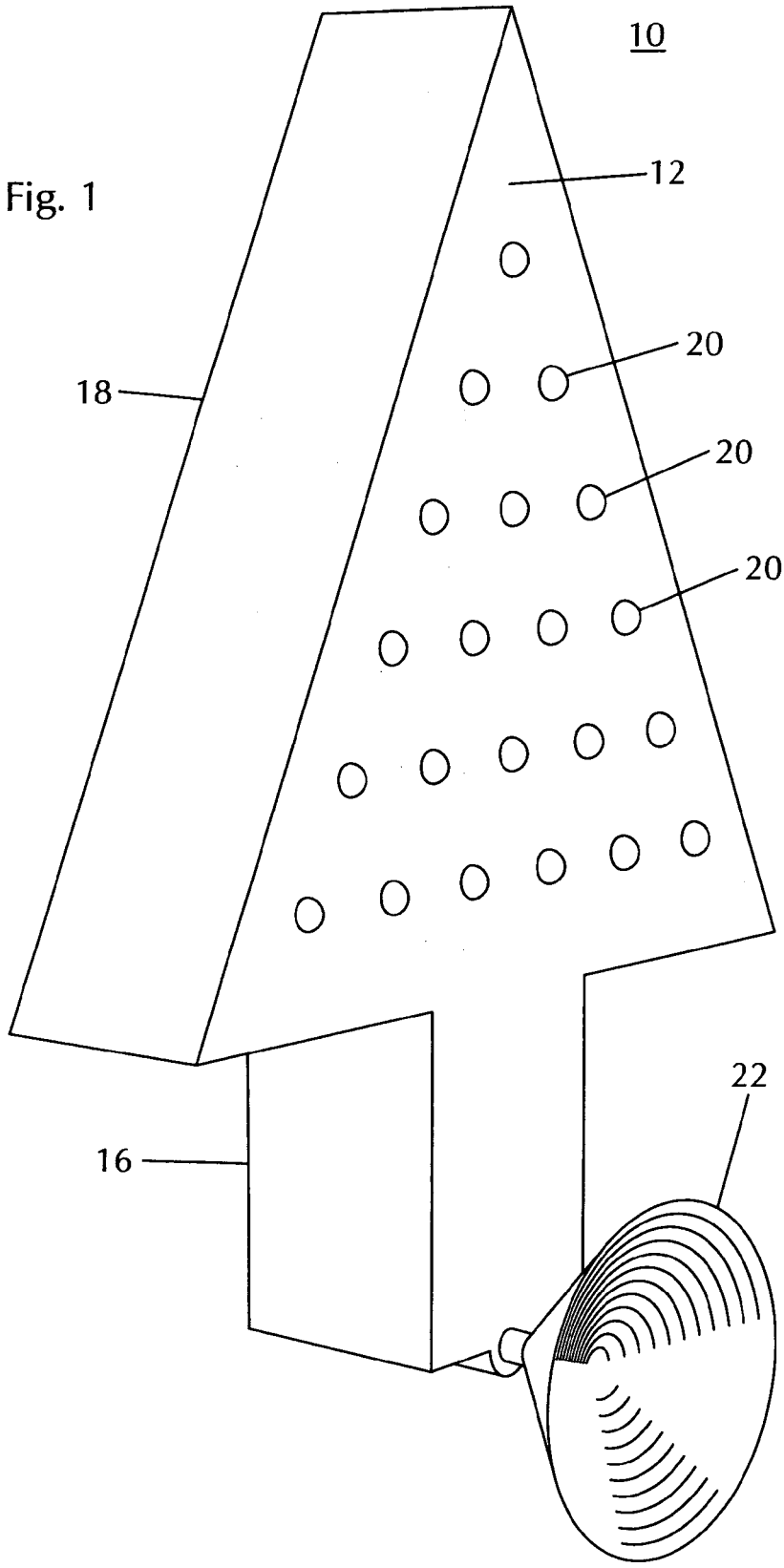
FIG. 1 is a three-quarter front perspective view of the present invention, illustrating the principal components thereon, including preferred attachment means.
Figure 2:
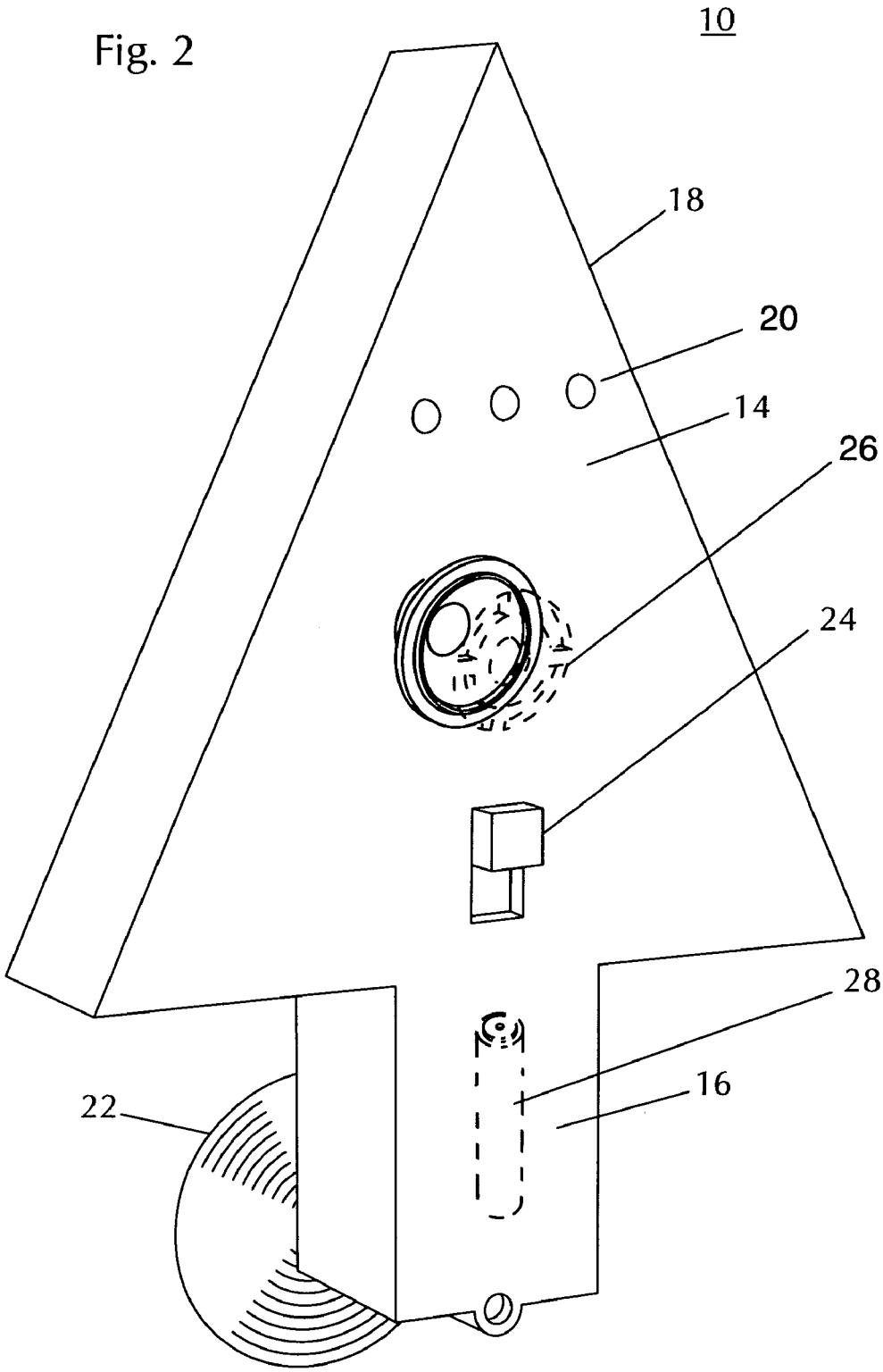
FIG. 2 is a three-quarter rear perspective view of the present invention, illustrating the opposing side of the device in question, including control switch location.

The following description refers to both FIG. 1, which is a three-quarter front perspective view of the present invention, illustrating the principal components located thereof, including preferred attachment means, and FIG. 2, which is a three-quarter rear perspective view of the present invention, illustrating opposing side of the device in question, including control switch location.

A miniature portable ornamental tree device (10) comprises a front side (12), a rear side (14), a trunk portion (16), and a top portion (18). A control means (24) is located along an exterior surface of the rear side (14) of the device. The control means (24) functions to engage a power means, which is located within the trunk portion (16) of the device in the preferred mode.

The power means is selected from a group consisting of battery means (28) and electrical means. Thus, a manufacturer may choose between these options, based upon desired power output, weight of the device, various safety considerations, and overall durability. The power means functions to engage an illumination means (20), which located upon the front side of the device (12) and the rear side of the device (14) substantially along the top portion of the device (18).

In the preferred mode, the device (10) is manually engaged and disengaged by a switch (24) located upon the rear exterior surface, as shown. However, for the purposes of versatility, in an alternate mode operation of the device may be set to a timer. For instance, the device may be programmed to automatically turn on at a particular time or when the area in which the device is placed becomes sufficiently dark.

In the preferred mode of production, the illumination means (20) is a series of LED lights. However, in alternate modes of manufacture, the illumination means (20) may be a series of fiber optic lights or a series of standard bulbs. Such lights are simple, inexpensive, and relatively easy to manufacture and install. Still, the same provide sufficient illumination to accomplish the specific purposes of the present invention.

In any such mode, the illumination means (20) may colored to enhance the overall appearance of the decorative article (10). For instance, the lights (20) may be colored red to highlight the Christmas season, or may be colored white or substantially clear for a desired elegant appearance. Furthermore, the lights may be placed in many different patterns and arrangements, for the purpose of enhancing the overall appearance and adding to the uniqueness of the novelty device.

Next, an attachment means (22) comprises at least one suction cup member and, importantly, is removably affixed to the device (10) along the front surface of the device (12) or rear surface of the device (14). The attachment means (22) functions to allow the user to temporarily affix the miniature portable ornamental tree device (10) to a substantially glass surface, such as a home, office, or car window, for decorative purposes.

The attachment means (22) further functions to allow the user to reverse the orientation of the device (10) and temporarily affix an opposite side of the device to the window or other substantially glass surface.

Importantly, as noted, the device (10) may be utilized indoors or outdoors, as only a window or glass surface is necessary. Such is because the device is manufactured of generally lightweight and inexpensive materials, including plastic materials and artificial green tree materials.

In general, the device (10) is manufactured of an orientation selected from the group consisting of transparent, translucent, and opaque. A transparent or translucent orientation may provide additional interest by allowing the user to view the power means, wiring and linkages within the device.

In an advanced alternate form of manufacture, the device (10) may comprise an audio means (26). Such audio means may comprise at least one previously determined song that is consistent with a holiday theme for additional user enjoyment and entertainment.

In addition, the device may further comprise a stand assembly which functions to allow the device to sit atop of generally flat surface. Thus, users may place the article (10) on a desk or table to enhance the decor of a room or office.

Moreover, the device (10) may bear indicia upon the front side (12) and rear side (14) thereof. Finally, the exterior surface of the device (10) may be decoratively painted in a manner consistent with a holiday theme.

With regards to all FIGURES, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention.

What is claimed as new and desired to be protected by Letters Patent is set forth in the appended claims:

1. A miniature portable ornamental tree device manufactured of translucent plastic and artificial green tree material, which is removable attachable to a window, comprising:

a front side, a rear side, a trunk portion, and a top portion, the device manually engaged and disengaged by a switch located upon the rear side;

the switch functioning to engage a power means in the form of at least one battery, the battery functioning to engage an illumination means which is located upon the front side of the device and the rear side of the device substantially along the top portion of the device, the illumination means comprising a series of colored blinking LED lights, the illumination means configured according to at least one previously determined pattern of arrangement;

an attachment means comprising at least one suction cup member is removably affixed to the device along the front side of the device or rear side of the device, which may be reversed from the front side to the rear side thereof, functioning to allow the device to be temporarily affixed to the inside or outside of a window for decorative purposes, and the device further comprising an audio means comprising at least one previously determined song that is consistent with a holiday theme.

2. The miniature portable ornamental tree device as described in claim 1, wherein the device is utilized indoors.

3. The miniature portable ornamental tree device as described in claim 1, wherein the device is utilized outdoors.

4. The miniature portable ornamental tree device as described in claim 1, wherein the device is translucent, functioning to provide additional interest by allowing the user to view the power means, wiring and linkages within the device.

* * * * *